United States Patent [19]

Brown et al.

[11] Patent Number: 4,757,296

[45] Date of Patent: Jul. 12, 1988

[54] ELECTRICAL FUSELINKS

[75] Inventors: Russell Brown, Frome; John D. Flindall, Rode, Nr. Bath, both of England

[73] Assignee: Dubilier PLC, England

[21] Appl. No.: 46,959

[22] PCT Filed: Aug. 5, 1986

[86] PCT No.: PCT/GB86/00473

§ 371 Date: Mar. 26, 1987

§ 102(e) Date: Mar. 26, 1987

[87] PCT Pub. No.: WO87/00964

PCT Pub. Date: Feb. 12, 1987

[30] Foreign Application Priority Data

Aug. 5, 1985 [GB] United Kingdom ..... 8519601

[51] Int. Cl.[4] ..... H01H 85/18; H01H 85/38

[52] U.S. Cl. ..... 337/276; 337/273; 337/280

[58] Field of Search ..... 337/273, 276, 280

[56] References Cited

U.S. PATENT DOCUMENTS

| | | | |
|---|---|---|---|
| 1,016,443 | 2/1912 | Sachs | 337/280 |
| 1,480,225 | 1/1924 | Snook | 337/280 |
| 3,492,619 | 1/1970 | Hagler et al. | 337/276 |

*Primary Examiner*—H. Broome

*Attorney, Agent, or Firm*—Biebel, French & Nauman

[57] ABSTRACT

An electrical fuselink having improved surge-resistant characteristics comprises a fuse element (1) disposed in an electrically insulating enclosure (4) having all or part of the air-space within the enclosure filled with a microporous or microcellular insulating material (2) which has low intrinsic thermal conductivity and cavities or cells of a size less than the average inter-molecular collision distance of the gas, normally air, occupying its cavities or cells. The fuse element is connected between electrical leads (3) which project from the enclosure for connecting the fuselink in an electrical circuit.

7 Claims, 2 Drawing Sheets

ELECTRICAL FUSELINKS

BACKGROUND OF THE INVENTION

The present invention relates to electrical fuselinks and, more particularly, to fuselinks having improved surge-resistant characteristics, for example, a 1 mS delay factor>200.

The delay factor or D.F. is a measure of a fuselink's surge resistance and is defined by the ratio of $I_s$, $/I_f$, where $I_s$ is the current required to blow the fuse in a short specified time (1–10 mS), and $I_f$ is the minimum fusing current, that is, the least current which will ultimately blow the fuse if allowed sufficient time.

It has been discovered that one parameter which significantly influences the D.F. of a fuselink is the heat loss from the fuse element. The greater the heat loss, the less is the delay factor. In a conventional cartridge fuselink, for example, some heat is conducted axially along the fuse element to the end caps and a small amount is radiated from the surface of the fuse element but, in an air-filled fuselink, most of the heat loss is by convection to the surrounding ceramic or glass barrel. For example, an increase of 2.7:1 in the D.F. of a 20×5 mm cartridge fuselink could be expected if it were practicable to reduce the heat loss by evacuating the air-space within the insulating barrel.

Moreover, it has been discovered experimentally that the introduction of any of the conventional solid thermal insulants into the air-space within the insulating barrel of a cartridge fuselink (e.g. a 20×5 mm fuselink) has the surprising detrimental effect of increasing and not decreasing the heat loss. The thermal conductivity of the solid material with its entrapped air is greater than that of free air in a fuselink of this size. The materials evaluated included fibreglass, polystyrene foam and vermiculite. Of course, the provision of a vacuum or reduced air pressure within the space in the insulating barrel would provide for reduced heat loss in relation to that achieved with free air but such a provision is not generally a practical or economical proposition for cartridge fuselinks.

SUMMARY OF THE INVENTION

The present invention has as an object to provide an electrical fuselink having reduced heat loss, and hence improved surge resistance, in relation to hitherto known fuselinks of the same type, and is based on the discovery that in order to decrease heat loss from a fuselink by the use of a solid insulating material, the latter must have certain other characteristics besides a low intrinsic thermal conductivity.

To this end, the invention consists in an electrical fuselink comprising a fuse element and a solid thermal insulating material arranged to reduce heat loss from the fuse element, characterised in that the insulating material includes a multiplicity of cavities or cells which are sufficiently small in size so that the maximum distance apart of the walls of each cavity or cell is less than the mean free path of a molecule of the gas, usually air, occupying the cavities or cells. For example, with an insulating material in which the voidage is occupied by air, the maximum distance apart of the walls of each microcavity or cell must be less than 0.1 microns at normal temperature and pressure or N.T.P. Hence, the cavity or cell size is such as to inhibit conduction by inter-molecular collision of the gas molecules and convection currents are not set-up.

A suitable solid insulating material which has low intrinsic thermal conductivity and which uses this microporous principle to reduce heat transference by conduction and convection is an ultra fine powder of amorphous silica structured and bonded to give an extremely small cavity size which is less than the average intermolecular collision distance of air. This material is commercially marketed under the trademark "Microtherm" by Micropore International Ltd. of Hadzor Hall, Droitwich, Worcester, WR9 7DJ, Great Britain.

The invention may be applied to a cartridge or other fuselink in which the fuse element is enclosed within an electrically insulating barrel or housing. In either event, all or part of the air-space within the enclosure may be filled with the insulating material so that the heat loss is lower and the D.F. is correspondingly higher. In other embodiments, the air-space may be partly filled simply by coating the fuse element or by lining the inside of the enclosure with the insulating material or both.

BRIEF DESCRIPTION OF THE DRAWINGS

In order that the present invention may be more readily understood, reference will now be made to the accompanying drawings, in which.

DESCRIPTION OF THE PREFERRED EMBODIMENTS

Figure 1:
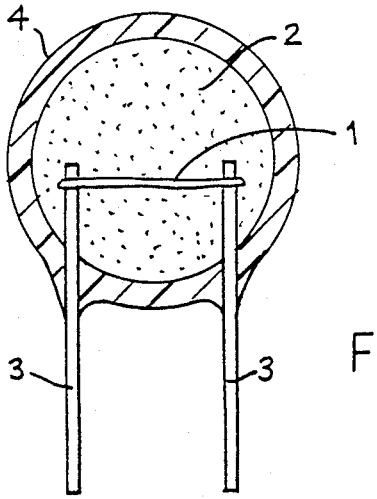
FIG. 1 is a sectional view through an encapsulated fuselink embodying the invention.

Referring to FIG. 1 of the drawings, this embodiment of fuselink comprises a wire fuse element 1 encapsulated within a spherical body 2 of a solid microporous or microcellular insulating material, such as that sold under the trademark "Microtherm", which has a low intrinsic thermal conductivity and an extremely small cavity or void size so that the maximum distance apart of the walls of each cavity is less than the average intermolecular collision distance of air. The fuse element 1 is connected between two electrically conductive leads 3 which project from the encapsulating body 2. As the material of the body is fragile, the latter is dip-coated with an epoxy resin material to form a protective coating 4 about the body and embracing the leads 3 where they project from the body.

Figure 2:
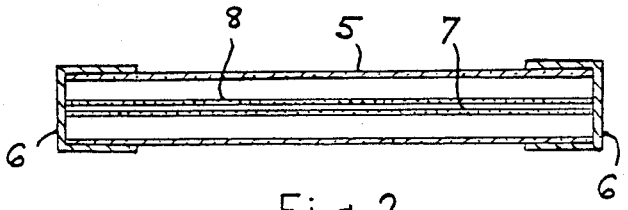
FIGS. 2 and 3 are sectional views through two miniature cartridge fuselinks embodying the invention.
Figure 3:
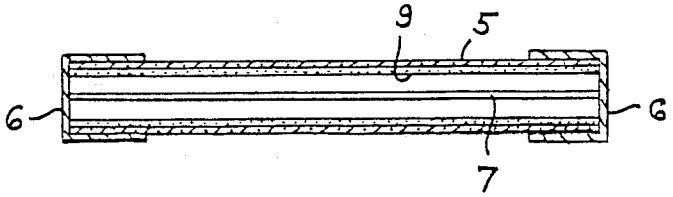

FIG. 2 illustrates a miniature cartridge fuselink comprising a barrel 5 formed from electrical insulating material, e.g. glass, end caps 6, and a wire fuse element 7 electrically connecting the end caps and extending through the barrel. The wire fuse element 7 is coated with a layer 8 of "Microtherm" insulating material. The embodiment illustrated in FIG. 3 is similar to that shown in FIG. 2 except that a lining 9 of "Microtherm" insulating material is formed about the inside of the insulating barrel 5 instead of as a coating on the fuse element 7.

Figure 4:
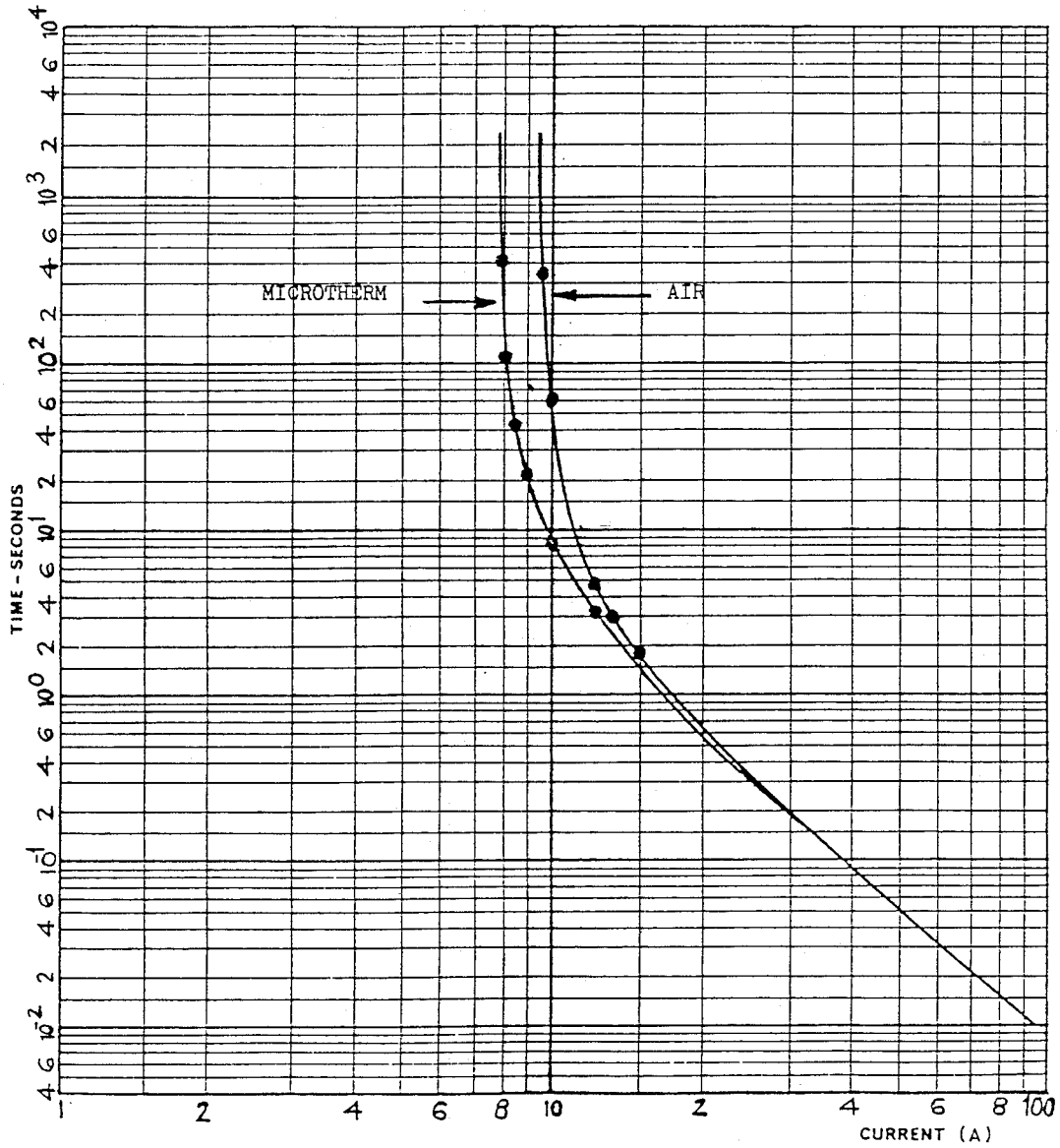
FIG. 4 is a graph illustrating the results of comparative tests.

In order to compare the insulating properties of "Microtherm" and air in fuselink applications, tests were made with 0.335 mmϕ Ag clad Sn-Zn wire fuse elements in 0.53 mmϕ holes in a block of "Microtherm" material and with the same fuse wire made up into several cartridge fuselinks having ceramic barrels and pierced end caps. Electrical current was applied to the wire fuse elements of these samples until the samples were blown and the two sets of blowing times, one for wire fuse elements disposed in "Microtherm" and the other for wire fuse elements inside unfilled cartridge fuselinks, are represented as time/current curves in FIG. 4.

It can be seen that the effect of insulating the fuse wire with "Microtherm" is to decrease the minimum fusing current (m.f.c.) from 9.5 A to 7.8 A, a reduction of 18%, whilst the performance at high overloads is unchanged. This implies an increase in delay factor equal to the ratio of m.f.c.'s i.e. the delay factor is increased by 9.5/7.8 = 1.22 times or 22%.

To investigate the effect of end caps some "Microtherm" enclosed fuse wires had end caps soldered to them and blowing tests performed for a single current value of 8 A. The times were reduced from an average of ~150 s without caps to ~110 s with caps. By adding end caps, the thermal resistance path from the element to ambient is increased by an amount greater than the extra heat loss they introduce, thus the wire heats and blows more quickly. This would give a further increase in delay factor.

Whilst certain embodiments have been described, it will be understood that modifications may be made without departing from the scope of the invention as defined by the appended claims.

We claim:

1. In an electrical fuselink including a fuse element connected between terminal means and solid thermal insulating material arranged about said fuse element in a manner to reduce heat loss therefrom, the improvement which provides for further reducting heat loss from said fuse element and enhancement of the surge resistance thereof and which is characterised in that said insulating material includes a multiplicity of cavities having walls of said insulating material and occupied by gas, said cavities being sufficiently small in size so that the maximum distance apart of said walls of each said cavity is less than the mean free path of a molecule of said gas occupying said cavities.

2. The fuselink claimed in claim 1, wherein said gas occupying said cavities of said insulating material is air and said maximum distance apart of said walls of each said cavity is less than 0.1 microns at N.T.P.

3. The fuselink claimed in claim 1, wherein said insulating material is an ultra fine powder of amorphous silic structured and bonded to provide said cavities having sizes of the required dimensions.

4. The fuselink claimed in claim 1, wherein said fuse element is disposed within an electrically insulating enclosure, said electrically insulating enclosure having an inside defining an air space at least partially filled with said insulating material.

5. The fuselink claimed in claim 4, wherein said inside of said electrically insulating enclosure is lined with said insulating material.

6. The fuselink claimed in claim 1, wherein said fuse element is coated with a layer of said insulating material.

7. The fuselink claimed in claim 1, wherein said fuse element is encapsulated in said insulating material.

* * * * *

UNITED STATES PATENT AND TRADEMARK OFFICE

CERTIFICATE OF CORRECTION

PATENT NO. : 4,757,296

DATED : July 12, 1988

INVENTOR(S) : Russell Brown and John D. Flindall

It is certified that error appears in the above-identified patent and that said Letters Patent is hereby corrected as shown below:

Claim 3, line 16, "silic" should be --silica--.

Signed and Sealed this

Fifteenth Day of November, 1988

*Attest:*

DONALD J. QUIGG

*Attesting Officer*

*Commissioner of Patents and Trademarks*